US010988824B2

(12) United States Patent
Gomes et al.

(10) Patent No.: US 10,988,824 B2
(45) Date of Patent: Apr. 27, 2021

(54) CORROSION RESISTANT STEEL, METHOD FOR PRODUCING SAID STEEL AND ITS USE THEREOF

(71) Applicant: VALLOUREC OIL AND GAS FRANCE, Aulnoye-Aymeries (FR)

(72) Inventors: Christelle Gomes, Aulnoye-Aymerie (FR); Hafida El Alami, Aulnoye-Aymerie (FR); Florent Decultieux, Aulnoye-Aymerie (FR)

(73) Assignee: VALLOUREC OIL AND GAS FRANCE, Aulnoye-Aymeries (FR)

( * ) Notice: Subject to any disclaimer, the term of this patent is extended or adjusted under 35 U.S.C. 154(b) by 375 days.

(21) Appl. No.: 15/740,230

(22) PCT Filed: Jun. 29, 2016

(86) PCT No.: PCT/EP2016/065095
§ 371 (c)(1),
(2) Date: Dec. 27, 2017

(87) PCT Pub. No.: WO2017/001450
PCT Pub. Date: Jan. 5, 2017

(65) Prior Publication Data

US 2018/0187279 A1 Jul. 5, 2018

(30) Foreign Application Priority Data

Jun. 29, 2015 (EP) ..... 15174339

(51) Int. Cl.

| | |
|---|---|
| ***C22C 38/52*** | (2006.01) |
| ***C22C 38/48*** | (2006.01) |
| ***C22C 38/50*** | (2006.01) |
| ***C22C 38/46*** | (2006.01) |
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C21D 9/08*** | (2006.01) |
| ***C22C 38/00*** | (2006.01) |
| *C21D 6/00* | (2006.01) |

(52) U.S. Cl.
CPC ..... *C21D 9/085* (2013.01); *C22C 38/001* (2013.01); *C22C 38/004* (2013.01); *C22C 38/04* (2013.01); *C22C 38/42* (2013.01); *C22C 38/44* (2013.01); *C22C 38/46* (2013.01); *C22C 38/48* (2013.01); *C22C 38/52* (2013.01); *C21D 6/004* (2013.01); *C21D 6/005* (2013.01); *C21D 6/007* (2013.01); *C21D 2211/001* (2013.01); *C21D 2211/004* (2013.01); *C21D 2211/005* (2013.01); *C21D 2211/008* (2013.01)

(58) Field of Classification Search
CPC ..... C22C 38/001; C22C 38/004; C22C 38/04; C22C 38/42; C22C 38/44; C22C 38/46; C22C 38/48; C22C 38/52
See application file for complete search history.

(56) References Cited

U.S. PATENT DOCUMENTS

| | | | | |
|---|---|---|---|---|
| 7,520,942 | B2 * | 4/2009 | Klueh | C21D 1/18 148/326 |
| 2006/0060270 | A1 | 3/2006 | Klueh et al. | |
| 2006/0243354 | A1 | 11/2006 | Kimura et al. | |
| 2010/0031530 | A1 | 2/2010 | Abshire | |
| 2010/0150770 | A1 | 6/2010 | Hiraide et al. | |
| 2012/0328897 | A1 | 12/2012 | Ohe et al. | |
| 2013/0081304 | A1 | 4/2013 | Abshire | |
| 2019/0100821 | A1 * | 4/2019 | Eguchi | C21D 9/08 |

FOREIGN PATENT DOCUMENTS

| | | | |
|---|---|---|---|
| CA | 2 795 326 | A1 | 11/2011 |
| EP | 1 662 015 | A1 | 5/2006 |
| GB | 821578 | | 10/1959 |
| JP | 2012097350 | * | 5/2012 |
| JP | WO2017010036 | * | 1/2017 |
| WO | WO 20170100360 | A1 * | 1/2017 |

OTHER PUBLICATIONS

JPWO 2017010036 machine translation of the description (Year: 2017).*
Eguchi et al. Derwent 2017-06074 N for patents including WO 2017010036 A1 (Year: 2017).*
JP 2012097350 Machine Translation (Year: 2012).*
International Search Report dated Sep. 7, 2016 in PCT/EP2016/065095 filed Jun. 29, 2016.

* cited by examiner

*Primary Examiner* — Xiaowei Su
(74) *Attorney, Agent, or Firm* — Oblon, McClelland, Maier & Neustadt, L.L.P.

(57) ABSTRACT

A corrosion resistant steel having a yield strength of at least 758 MPa is described. The corrosion resistant steel comprises in weight %: 0.005≤C<0.03, 14≤Cr≤17, 2.3≤Mo≤3.5, 3.2≤Ni≤4.5, Si≤0.6, 0.5≤Cu≤1.5, 0.4≤Mn≤1.3, 0.35≤V≤0.6, 3.2×C≤Nb≤0.1, W≤1.5, 0.5≤Co≤1.5, 0.02≤N≤0.05, Ti≤0.05, P≤0.03, S≤0.005, Al≤0.05, with the balance of the chemical composition of said corrosion resistant steel being constituted by Fe and inevitable impurities. A manufacturing method of such steel to obtain a quenched and tempered semi finished product is also described.

12 Claims, No Drawings

CORROSION RESISTANT STEEL, METHOD FOR PRODUCING SAID STEEL AND ITS USE THEREOF

The invention relates to stainless steels with yield strength of at least 758 MPa (110 ksi) and preferably at least 862 MPa (125 ksi) which have a sulphide stress cracking corrosion resistance and high temperature corrosion resistance better than standard martensitic stainless steels. The steel of the invention is used in production tubing and production liner, more rarely in the bottom of production casing.

Generally speaking, steels containing 13% Cr as defined in American petroleum Institute (API Specification 5CT Ninth Edition, Jan. 1, 2012 and API Specification 5CRA First Edition, Aug. 1, 2010) are used for wells that require a corrosion resistance. However, improved corrosion performance has been required for some pre□salt wells in the past years and a response was obtained through duplex material with an improved corrosion resistance compared to the former 13% Cr defined in the norm above mentioned.

When it comes to steel grades with improved corrosion resistance, the application WO2006117926 provides a stainless steel pipe for an oil well which exhibits excellent resistance to the corrosion by CO2 under a severe corrosion circumstance containing CO2, Cl, and the like. It exhibits excellent enlarging characteristics and can be produced at an advantageous cost. It deals with a stainless steel pipe for an oil well excellent in enlarging characteristics, which has a chemical composition that C: 0.05% or less, Si: 0.50% or less, Mn: 0.10 to 1.50%, P: 0.03% or less, S: 0.005% or less, Cr: 10.5 to 17.0%, Ni: 0.5 to 7.0%, Mo: 3.0% or less, Al: 0.05% or less, V: 0.20% or less, N: 0.15% or less, O: 0.008% or less, and optionally, respective specific contents of one or more of Nb, Cu, Ti, Zr, Ca, B and W, and the balance: Fe and inevitable impurities, and which has a structure wherein a tempered martensite phase is a main phase and an austenite phase is contained in an amount of more than 20%. Such steel yields interesting mechanical properties but is difficult to produce in hot conditions to obtain a steel with improved corrosion resistance. The corrosion resistance of this steel can still be improved.

Then comes application EP2224030 with a ferritic stainless steel with excellent brazeability and including, in terms of mass percent, 0.03% or less of C, 0.05% or less of N, 0.015% or more of C+N, 0.02 to 1.5% of Si, 0.02 to 2% of Mn, 10 to 22% of Cr, 0.03 to 1% of Nb, and 0.5% or less of Al, and further includes Ti in a content that satisfies the following formulae (1) and (2), with the remainder composed of Fe and unavoidable impurities. Ti−3 N≤0.03 (1) and 10 (Ti−3 N)+Al≤0.5 (2) (Here, the atomic symbols in formulae (1) and (2) indicate the content (mass %) of the respective element, and the numerical values that precedes the atomic symbols are constants). Such invention is used for coolers, oil coolers, heat exchange equipments used in automobiles and various types of plants, aqueous urea solution tanks used in automotive urea SCR (Selective Catalytic Reduction) systems, automotive fuel delivery system components, and the like. The mechanical properties offered by ferritic stainless steels and the corrosion resistance offered do not match with requirements for production tubing.

It is also known application WO2012117546, the purpose of this invention being to provide a martensitic stainless steel which shows high performance even in a severe corrosive environment which has a partial hydrogen sulfide pressure exceeding 0.03 atm. The stainless steel is an oil well pipe constituted of a low-C, high-Cr alloy steel of the 862 MPa grade and having high corrosion resistance, characterized by containing, in terms of mass %, 0.005-0.05% C, 12-16% Cr, up to 1.0% Si, up to 2.0% Mn, 3.5-7.5% Ni, 1.5-3.5% Mo, 0.01-0.05% V, up to 0.02% N, and 0.01-0.06% Ta and satisfying relationship (1), with the remainder comprising Fe and incidental impurities. 25-25[% Ni]+5[% Cr]+25[% Mo]≥0 (1). Such steel yields interesting mechanical properties but is difficult to produce in hot conditions to obtain steel with improved corrosion resistance. Yet, corrosion resistance can still be improved.

The steel according to the invention aims at solving above mentioned problems with a steel that has an improved corrosion resistance and an improved fracture toughness resistance while being easy to produce in hot conditions.

To do so, the object of the steel according to the invention is a steel of at least 758 MPa of yield strength comprising in weight %:

0.005≤C<0.03
14≤Cr≤17
2.3≤Mo≤3.5
3.2≤Ni≤4.5
Si≤0.6
0.5≤Cu≤1.5
0.4≤Mn≤1.3
0.35≤V≤0.6
3.2×C≤Nb≤0.1
W≤1.5
0.5≤Co≤1.5
0.02≤N≤0.05
Ti≤0.05
P≤0.03
S≤0.005
Al≤0.05

The balance of the chemical composition of said steel being constituted by Fe and inevitable impurities.

The present invention may also exhibit the characteristics listed below, considered individually or in combination.

In a preferred embodiment, the steel according to the invention comprises, in weight %: 15.5≤Cr≤16.5.

In another preferred embodiment, the steel according to the invention comprises, in weight %: 0.8≤Cu≤1.2.

Preferably, the steel according to the invention has a microstructure comprising between 30% and 50% of ferrite.

Preferably, the steel according to the invention has a microstructure comprising between 5% and 15% of austenite.

Preferably, the steel according to the invention has a microstructure comprising between 35% and 65% of martensite.

In another preferred embodiment, the steel according to the invention has a microstructure with less than 0.5% intermetallics in volume fraction.

In another preferred embodiment, the steel according to the invention has a microstructure with no intermetallics.

In an alternative embodiment, the steel according to the invention has a yield strength of at least 862 MPa (125 ksi).

In a preferred embodiment, the steel according to the invention has a fracture toughness resistance at −10° C. of at least 68 J.

An additional object of the present invention is the manufacturing method of a steel tube wherein:

A steel having a composition according to the invention is provided,

Then the steel is hot formed at a temperature comprised between 1150° C. and 1260° C. through commonly known hot forming processes such as forging, rolling, extrusion to obtain a tube, those processes being eventually combined in at least one step, then, the tube is heated up to a temperature AT comprised between 920° C. and 1050° C. and kept at the temperature AT during a time comprised between 5 and 30 minutes followed by cooling to the ambient temperature to obtain a quenched tube, then, the quenched tube is heated up to a temperature TT comprised between 500° C. and 700° C. and kept at the temperature TT during a time Tt comprised between 5 and 60 minutes followed by cooling to the ambient temperature to obtain a quenched and tempered tube.

In a preferred embodiment, at least one cooling to the ambient temperature is done using water.

In a preferred embodiment, the tempering time Tt is comprised between 10 and 40 min.

Ideally, the steel according to the invention produced with the method according to the invention is used to obtain a seamless steel tube for at least one of the following: well drilling, production, extraction, and/or transportation of oil and natural gas.

Also, within the framework of the present invention, the influence of chemical composition elements, preferable microstructural features and production process parameters will be further detailed below.

The chemical composition ranges are expressed in weight percent.

Carbon

Carbon content must be comprised between 0.005% and 0.03%, where the lower limit of 0.005 is included and the higher limit of 0.03 is excluded. If the carbon content is below 0.005%, the decarburization process becomes too long and difficult while industrial productivity is negatively impacted. If the carbon content is above or equal to 0.03%, since carbon is an austenite forming element, there will be too much austenite content at the expense of the martensite, as austenite phase yield strength is lower than martensite phase yield strength, this will result in a soft steel with a yield strength that hardly reaches 110 ksi (758 MPa) and even more hardly the 125 ksi (862 MPa) target.

Chromium

Cr content must be comprised between 14% and 17%, where the lower and higher limits are included. If the Cr content is below 14%, the resistance to corrosion will be below expectations, indeed, Cr improves corrosion performances by increasing the corrosion resistance of the protective scale. The impact of Cr content on corrosion is higher in high temperature environments in the presence high partial pressures of CO2. If the Cr content is above 17%, there will be too much ferrite content at the expense of the martensite phase. As ferrite phase yield strength is lower than martensite phase yield strength, this will result in a soft steel with a yield strength that hardly reaches 110 ksi (758 MPa) and even more hardly the 125 ksi (862 MPa) target. In addition Cr content above 17% degrades the toughness and the hot workability. In a preferred embodiment, the Cr content is between 15.5% and 16.5%, with the limits included.

Molybdenum

Mo content must be comprised between 2.3% and 3.5%, where the lower and higher limits are included. If the Mo content is below 2.3%, the resistance to corrosion will be below expectations, indeed, Mo improves corrosion performances by increasing the corrosion resistance of the protective scale. The impact of Mo content on corrosion is higher on sulphide stress corrosion cracking. If the Mo content is above 3.5%, it will favor the precipitation of intermetallics which are detrimental to toughness. Preferably, no intermetallics are present in the steel according to the invention.

Nickel

Nickel is an important element in this invention. However, it stabilizes austenite at the expense of martensite if its content is too high. On the other hand, if its content is too low, the ferrite phase will be too high at the expense of martensite. Since ferrite and austenite phases yield strengths are lower than martensite yield strength, this will result in a soft steel with a yield strength that hardly reaches 110 ksi (758 MPa) and even more hardly the 125 ksi (862 MPa) target. A balance must therefore be found for this element, such balance is obtained for a content of Ni between 3.2 and 4.5%, with the limits included.

Silicon

Si is a ferrite forming element. As a consequence, if the Si content is above 0.6%, the ferrite phase will be too high at the expense of martensite. Since ferrite is a soft phase, this will result in a soft steel with a yield strength that hardly reaches 110 ksi (758 MPa) and even more hardly the 125 ksi (862 MPa) target. Si content must therefore be below or equal to 0.6%.

Copper

Copper content must be between 0.5% and 1.5%, the limits being included. If the Cu content is below 0.5%, the resistance to corrosion will be below expectations, indeed, Cu improves corrosion resistance. The impact of Cu content on corrosion is higher in high temperature environments in the presence of high partial pressures of CO2. However, if the copper content is above 1.5%, the hot workability is negatively impacted resulting in surface defects after hot forming. Preferably, the copper content is between 0.8% and 1.2%, the limits being included.

Manganese

Mn content must be between 0.4% and 1.3%, the limits being included. Mn stabilizes austenite at the expense of martensite if its content is too high. On the other hand, if its content is too low, the ferrite phase will be too high at the expense of martensite. Since ferrite and austenite phases yield strength are lower than martensite yield strength, this will result in a soft steel with a yield strength that hardly reaches 110 ksi (758 MPa) and even more hardly the 125 ksi (862 MPa) target. In addition, above 1.3% of Mn, the corrosion resistance is below expectations. A balance must therefore be found for this element, such balance is obtained for a content of Mn between 0.4 and 1.3%, with the limits included.

Vanadium

Vanadium is an important element of the invention. V content must be between 0.35% and 0.6%, the limits being included. According to the invention, V forms carbo-nitrides (V(C,N)) that are inter and intra granular and that have a size inferior to 500 nm and preferably from 30 to 200 nm. Such precipitates contribute to increase the yield strength and improve the grain boundary cohesion. The contribution to yield strength of V precipitates balances the loss of strength due to the presence of soft ferrite. In addition, it has been demonstrated that the presence of V in the amount of 0.35% to 0.6% keeps intermetallics from precipitating, those intermetallics are detrimental to toughness. Below 0.35% of V, its contribution is not enough to reach the yield strength of 110 ksi (758 MPa) or even the 125 ksi (862 MPa) target. Above, 0.6%, there is a saturation effect on top of useless alloying cost increase.

Niobium

Nb content must be such that: $3.2 \times C \leq Nb \leq 0.1\%$ where C and Nb are in weight percent. Nb is added so as to keep carbon from stabilizing austenite. Indeed, niobium carbides (NbC) trap the C which will not serve as an austenite stabilizer. A minimum Nb content of 3.2×% C is needed to provide such C trapping effect. Above 0.1%, the toughness is dramatically impacted and decreases very rapidly.

Tungsten

W content must be below or equal to 1.5%. If the W content is above 1.5%, there will be too much ferrite content at the expense of the martensite phase, as ferrite phase yield strength is lower than martensite phase yield strength, this will result in a soft steel with a yield strength that hardly reaches 110 ksi (758 MPa) and even more hardly the 125 ksi (862 MPa) target. Furthermore, the presence of W favors the precipitation of intermetallics which are detrimental to toughness.

Cobalt

Co content must be between 0.5% and 1.5%, where limits are included. Below 0.5%, the target of 110 ksi (758 MPa) is difficult to reach because Co has a strengthening effect. The 125 ksi (862 MPa) target is even harder to reach. In addition, below 0.5% of Co, the corrosion resistance in high temperature environments in the presence of high partial pressures of CO2 decreases until a non satisfactory level. Furthermore, it has been demonstrated that Co above 0.5% keeps intermetallics from precipitating, those intermetallics are detrimental to toughness. Above 1.5% of Co, there is a saturation effect expected on top of useless alloying cost increase.

Nitrogen

Nitrogen content must be between 0.02% and 0.05%, where the limits are included. Nitrogen improves the resistance to corrosion. Below 0.02% of nitrogen, the effect on corrosion resistance is insufficient. Above 0.05%, austenite content is increased; indeed, nitrogen stabilizes austenite at the expense of martensite. High austenite content at the expense of martensite will lead to a grade below 110 ksi (758 MPa) since martensite yield strength is lower than austenite yield strength.

Residual Elements

The balance is made of Fe and inevitable impurities resulting from the steel production and casting processes. The contents of main impurity elements are limited as below defined for titanium, phosphorus, sulphur and aluminum:

$Ti \leq 0.05\%$ $P \leq 0.03\%$ $S \leq 0.005\%$ $Al \leq 0.05\%$

Other elements such as Ca and REM (rare earth minerals) can also be present as unavoidable impurities.

The sum of impurity element contents is lower than 0.1%.

Process Conditions

The method claimed by the invention comprises the following successive steps listed below. In this best embodiment, a steel tube is produced.

A steel having the composition claimed by the invention is obtained according to a method known by the man skilled in the art. Then the steel is heated at a temperature between 1150° C. and 1260° C., so that at all points the temperature reached is favorable to the high rates of deformation the steel will undergo during hot forming. This temperature range is needed to be in the ferritic-austenitic range. Preferably the maximum temperature is lower than 1230° C. to avoid excessive ferrite phase which might favor hot forming defects. Below 1150° C., the ferrite content during hot forming is too low, which impacts negatively the hot ductility of the steel. The semi finished product is then hot formed in at least one step and we obtain a tube with the desired dimensions.

The tube is then austenized i.e. heated up to a temperature AT where the microstructure is ferritic-austenitic. The austenitization temperature AT is preferably between 920° C. and 1050° C.; if AT is less than 920° C., intermetallics are not dissolved and impact negatively toughness of the material when their amount is above 0.5% in volume fraction. Above 1050° C., the austenite and ferrite grains grow undesirably large and lead to a coarser final structure, which impacts negatively toughness.

The tube made of steel according to the invention is then kept at the austenitization temperature AT for an austenitization time At of at least 5 minutes, the objective being that at all points of the tube, the temperature reached is at least equal to the austenitization temperature. It is to make sure that the temperature is homogeneous throughout the tube. The austenitization time At shall not be above 30 minutes because above such duration, the austenite and ferrite grains grow undesirably large and lead to a coarser final structure. This would be detrimental to toughness.

Then, the tube made of steel according to the invention is cooled to the ambient temperature, preferably using water quenching. In this manner, a quenched tube made of steel is obtained which contains in area percentage 30 to 50% ferrite, 5 to 15% of residual austenite and 35 to 65% of martensite.

Then, the quenched tube made of steel according to the invention is preferably tempered i.e. heated at a tempering temperature TT comprised between 500° C. and 700° C., preferably between 500° C. and 650° C. Such tempering is done during a tempering time Tt between 5 and 60 minutes. Preferably, the tempering time is between 10 and 40 min. This leads to a quenched and tempered steel tube.

Finally, the quenched and tempered steel tube according to the invention is cooled to the ambient temperature using either water or air cooling.

Microstructural Features

Ferrite

Ferrite content in the steel according to the invention must be between 30% and 50% in the final tube, the limits being included. Below 30% of ferrite, the hot workability is negatively impacted. Indeed, at high temperatures, i.e. above 900° C., ferrite and austenite both co-exist during hot rolling. Since ferrite is significantly softer than austenite, it will deform first. The lower the ferrite content, the higher the strain localization and therefore, the higher the microcracks appearance probability. Above 50% of ferrite, the martensite content is not high enough to allow reaching the 110 ksi (758 MPa) grade. Reaching the 125 ksi (862 MPa) grade is even harder.

Austenite

Austenite content in the steel according to the invention must be between 5% and 15% in the final tube, the limits being included. A positive effect of austenite presence has been discovered on corrosion in high temperature environments in the presence of high partial pressures of CO2 with a steel according to the invention. Below 5%, such positive effect disappears. Above 15%, the martensite content is not high enough to allow reaching the 110 ksi (758 MPa) grade. Reaching the 125 ksi (862 MPa) grade is even harder.

Martensite

Martensite content in the steel according to the invention must be between 35% and 65% in the final tube, the lower and higher limits being excluded. It has been found that martensite is the weakest phase regarding corrosion resistance when compared to ferrite and austenite, however its strength is needed to reach the 110 ksi (758 MPa) grade at least.

Below 35%, the 110 ksi (758 MPa) grade is not reached since martensite brings strength. Above 65% of martensite, the hot workability is negatively impacted due to the low ferrite content associated with such high martensite phase content. Moreover, the corrosion in high temperature environments in the presence of high partial pressure of CO2 will be negatively impacted.

In a preferred embodiment, the quenched and tempered steel tube according to the invention, after final cooling, presents a microstructure with less than 0.5 intermetallics in volume fraction. Ideally, there are no intermetallics since they are detrimental to the toughness of the steel according to the invention.

In a preferred embodiment, the steel according to the invention has an improved toughness, i.e. a toughness value expressed in joules at −10° C. of at least 68 J.

In a preferred embodiment, the steel according to the invention is a corrosion resistant steel presenting a corrosion rate of less than 0.13 mm/year. The test is detailed in the example section.

In an even more preferred embodiment, the steel according to the invention is a corrosion resistant steel presenting excellent sulphide stress corrosion cracking resistance. The test is detailed in the example section.

The invention will be illustrated below on the basis of the following non-limiting examples:

Steels have been prepared and their compositions are presented in the following table 1, expressed in weight percent.

The compositions of steels 11 to 15 are according to the invention.

For the purpose of comparison the compositions R1 to R12 are for steels which are used for the fabrication of references and are not according to the invention.

Underlined Values are not in Conformance with the Invention

The upstream process (from melting to hot forming) is done with commonly-known manufacturing method for seamless steel pipes after heating at a temperature between 1150° C. and 1260° C. for hot forming. For example, it is desirable that molten steel of the above constituent composition be melted by commonly-used melting practices. The common methods involved are the continuous casting process, the ingot casting-blooming method for instance. Next, these materials are heated, and then manufactured into pipe by hot working by the Mannesmann-plug mill process or the Mannesmann-mandrel mill process, which are commonly-known manufacturing methods, into seamless steel pipes of the above constituent composition into the desired dimensions.

The compositions of table 1 have undergone a production process that can be summarized in the table 2 below with:

AT (° C.): Austenitization temperature in ° C.

At: Austenitization time in minutes

TT: Tempering temperature in ° C.

Tt: Tempering time in minutes

The cooling methods represent the medium in which the cooling is performed and the "intermetallics" column in table 3 discloses whether intermetallics are present above 0.5% in volume fraction in the steel microstructure or not.

TABLE 2 process conditions of examples after forging and rolling

| Material | Steel ID | AT (° C.) (° C.) | At (min) | Cooling after austenitization | Tt (° C.) | Tt (min) | Cooling after tempering |
|---|---|---|---|---|---|---|---|
| QQF | I1 | 1000 | 10 | Water | 550 | 30 | Water |
| PPE | I2 | 1000 | 10 | Water | 550 | 30 | Water |
| 0E | I3 | 1000 | 10 | Water | 570 | 30 | Water |
| 1F | I4 | 1000 | 10 | Water | 570 | 30 | Water |
| 2G | I5 | 1000 | 10 | Water | 570 | 30 | Water |
| D | R1 | 1000 | 10 | Water | 560 | 30 | Air |
| M3 | R2 | 960 | 10 | Water | 530 | 30 | Air |

TABLE 1 chemical compositions of examples

| Material | Steel ID | C | Cr | Mo | Ni | Si | Cu | Mn | V | 3.2 × C | Nb | W | Co | N | Ti | P | S | Al |
|---|---|---|---|---|---|---|---|---|---|---|---|---|---|---|---|---|---|---|
| QQF | I1 | 0.02 | 16.1 | 3.0 | 3.8 | 0.52 | 1.00 | 1.01 | 0.40 | 0.07 | 0.085 | 0.02 | 1.12 | 0.030 | 0.001 | 0.015 | 0.001 | 0.023 |
| PPE | I2 | 0.020 | 16.4 | 3.0 | 3.8 | 0.53 | 1.01 | 1.02 | 0.51 | 0.06 | 0.086 | 0.04 | 1.14 | 0.030 | 0.001 | 0.015 | 0.001 | 0.023 |
| 0E | I3 | 0.020 | 16.4 | 2.5 | 3.8 | 0.32 | 1.00 | 1.04 | 0.46 | 0.06 | 0.084 | 0.46 | 1.12 | 0.029 | 0.001 | 0.015 | 0.001 | 0.017 |
| 1F | I4 | 0.020 | 16.4 | 3.0 | 4.1 | 0.31 | 1.00 | 0.50 | 0.46 | 0.06 | 0.083 | 0.01 | 1.13 | 0.031 | 0.001 | 0.016 | 0.001 | 0.013 |
| 2G | I5 | 0.021 | 16.3 | 2.5 | 3.8 | 0.31 | 1.00 | 0.55 | 0.46 | 0.07 | 0.081 | 0.01 | 1.12 | 0.033 | 0.001 | 0.016 | 0.001 | 0.012 |
| D | R1 | 0.007 | 18.3 | 2.5 | 6.0 | 0.23 | 0.10 | 0.55 | 0.28 | 0.02 | 0.001 | 1.00 | 0.00 | 0.013 | 0.001 | 0.015 | 0.002 | 0.009 |
| M3 | R2 | 0.005 | 15.1 | 3.0 | 4.7 | 0.54 | 0.02 | 2.80 | 0.01 | 0.02 | 0.014 | 0.00 | 0.02 | 0.023 | 0.012 | 0.019 | 0.003 | 0.067 |
| LLA | R3 | 0.022 | 16.3 | 3.0 | 3.8 | 0.50 | 1.00 | 0.99 | 0.52 | 0.07 | 0.152 | 0.62 | 1.13 | 0.028 | 0.001 | 0.016 | 0.001 | 0.021 |
| X5 | R4 | 0.018 | 16.1 | 3.0 | 3.9 | 0.26 | 1.02 | 1 10 | 0.50 | 0.06 | 0.010 | 0.69 | 0.65 | 0.039 | 0.019 | 0.016 | 0.001 | 0.018 |
| TTI | R5 | 0.012 | 16.2 | 3.0 | 4.1 | 0.54 | 2.04 | 1.01 | 0.51 | 0.04 | 0.089 | 0.61 | 0.00 | 0.029 | 0.001 | 0.016 | 0.001 | 0.025 |
| A4 | R6 | 0.006 | 14.2 | 3.1 | 4.9 | 0.52 | 0.00 | 1.10 | 0.02 | 0.02 | 0.014 | 2.20 | 0.02 | 0.021 | 0.012 | 0.019 | 0.002 | 0.220 |
| V5 | R7 | 0.007 | 14.1 | 3.1 | 4.9 | 0.51 | 0.00 | 1.00 | 0.55 | 0.02 | 0.014 | 2.20 | 0.02 | 0.029 | 0.012 | 0.018 | 0.002 | 0.070 |
| N2 | R8 | 0.018 | 15.2 | 3.1 | 7.1 | 0.14 | 0.04 | 1.00 | 0.00 | 0.06 | 0.000 | 1.96 | 4.50 | 0.021 | 0.001 | 0.016 | 0.003 | 0.040 |
| K | R9 | 0.009 | 14.3 | 4.0 | 4.6 | 0.55 | 0.00 | 1.00 | 0.49 | 0.03 | 0.014 | 1.10 | 0.02 | 0.032 | 0.012 | 0.016 | 0.001 | 0.010 |
| C | R10 | 0.007 | 14.9 | 3.2 | 6.0 | 0.23 | 2.50 | 0.98 | 1.00 | 0.02 | 0.001 | 1.00 | 1.00 | 0.012 | 0.009 | 0.016 | 0.003 | 0.009 |
| B | R11 | 0.002 | 16.3 | 3.2 | 5.3 | 0.26 | 1.10 | 1.56 | 0.47 | 0.01 | 0.014 | 1.10 | 1.10 | 0.010 | 0.012 | 0.019 | 0.002 | 0.011 |
| 14 | R12 | 0.013 | 14.8 | 3.5 | 4.8 | 0.25 | 0.90 | 0.30 | 0.05 | 0.04 | 0.290 | 0.00 | 0.02 | 0.028 | 0.012 | 0.016 | 0.002 | 0.018 |

TABLE 2-continued process conditions of examples after forging and rolling

| Material | Steel ID | AT (° C.) (° C.) | At (min) | Cooling after austenitization | Tt (° C.) | Tt (min) | Cooling after tempering |
|---|---|---|---|---|---|---|---|
| LLA | R3 | 1000 | 10 | Water | 550 | 30 | Water |
| X5 | R4 | 1000 | 10 | Water | 550 | 30 | Water |
| TTI | R5 | 1000 | 10 | Water | 550 | 30 | Water |
| A4 | R6 | 960 | 10 | Water | 560 | 30 | Air |
| V5 | R7 | 960 | 10 | Water | 580 | 30 | Air |
| N2 | R8 | 960 | 10 | Water | 560 | 30 | Air |
| K | R9 | 1000 | 10 | Water | 570 | 30 | Air |
| C | R10 | 1000 | 10 | Water | 560 | 30 | Air |
| B | R11 | 1000 | 10 | Water | 560 | 30 | Air |
| 14 | R12 | 1000 | 10 | Water | 560 | 30 | Air |

The steels according to the invention 11 to 15 and the references R1 to R12 have undergone the process conditions summarized in table 2. This led to quenched and tempered steel tubes that, after final cooling from the tempering temperature, present the microstructures detailed in table 3:

TABLE 3

Microstructural features of examples

| Material | Steel ID | ferrite (%) | retained austenite (%) | Martensite (%) | Intermetallics |
|---|---|---|---|---|---|
| QQF | I1 | 49 | 10 | 41 | no |
| PPE | I2 | 44 | 14 | 42 | no |
| 0E | I3 | 30 | 10 | 60 | no |
| 1F | I4 | 38 | 12 | 50 | no |
| 2G | I5 | 34 | 8 | 58 | no |
| D | R1 | 37 | 60 | 3 | no |
| M3 | R2 | 29 | 24 | 47 | no |
| LLA | R3 | 51 | 17 | 32 | no |
| X5 | R4 | 32 | 34 | 34 | no |
| TTI | R5 | 54 | 26 | 20 | no |
| A4 | R6 | 53 | 0 | 47 | yes |
| V5 | R7 | 35 | 6 | 59 | yes |
| N2 | R8 | 11 | 89 | 0 | no |
| K | R9 | 48 | 6 | 46 | yes |
| C | R10 | 32 | 65 | 3 | no |
| B | R11 | 39 | 49 | 12 | no |
| 14 | R12 | 29 | 0 | 71 | yes |

"No" means that there is are no intermetallics and "yes" means that their content is above 0.5%

The quenched and tempered steel tube according to the invention, after final cooling (cooling after tempering), has the microstructure described in table 3. The process of table 2 applied to the chemical compositions of table 1 led also to mechanical behavior, corrosion resistance and toughness as summarized in table 4 below where:

YS in MPa and ksi is the yield strength obtained in tensile test as defined in standards ASTM A370 and ASTM E8.

UTS in MPa and ksi is the tensile strength obtained in tensile test as defined in standards ASTM A370 and ASTM E8.

KCV −10° C. is the fracture toughness at −10° C. using V-notched test bars as defined in standards ASTM A370 and ASTM E23, which should preferably be above 68 J.

Corrosion rate is the result of a mass loss test. This corrosion test is performed by immersing the test pieces for 14 days in a test solution containing 20 mass % NaCl aqueous solution. The liquid temperature is 230° C. with a 100 atm. $CO_2$ gas atmosphere pressure.

The mass of the test pieces is measured before and after immersion. The calculated corrosion rate derives from the mass reduction before and after immersion in the conditions mentioned above. Corrosion rate should preferentially be below 0.13 mm/year.

SSC resistance is the sulphide stress corrosion cracking resistance evaluated according standard NACE TM0177-2005 Method A. The SSC test consists in immersing the test specimens under load in an aqueous solution adjusted to pH 4 with the addition of acetic acid and sodium acetate in a test solution of 20 mass % NaCl. The solution temperature is 24° C., $H_2S$ is at 0.1 atm., $CO_2$ is at 0.9 atm. The testing duration is 720 hours, and the applied stress is 90% of the yield strength. After testing, the test specimens were observed for cracks. A successful test implies no failure and no crack on the specimens after 720 hours. This considered a "pass" in table 4.

Blank cells mean that the corresponding value has not been measured.

TABLE 4 mechanical properties, toughness and corrosion resistance of examples

| Material | Steel ID | YS (MPa) | YS (ksi) | UTS (MPa) | UTS (ksi) | YS/UTS | KCV −10° C. | Corrosion rate (mm/y) | SSC resistance |
|---|---|---|---|---|---|---|---|---|---|
| QQF | I1 | 837 | 122 | 1020 | 148 | 0.82 | 141 | 0.10 | pass |
| PPE | I2 | 807 | 117 | 1013 | 147 | 0.80 | 151 | 0.10 | pass |
| 0E | I3 | 903 | 131 | 1013 | 147 | 0.89 | 199 | <0.13 | pass |
| 1F | I4 | 895 | 130 | 1018 | 148 | 0.88 | 180 | <0.13 | pass |
| 2G | I5 | 913 | 132 | 1031 | 149 | 0.89 | 165 | <0.13 | pass |
| D | R1 | 413 | 60 | 731 | 106 | 0.57 | | | |
| M3 | R2 | 808 | 117 | 933 | 135 | 0.87 | 160 | 0.25 | fail |
| LLA | R3 | 787 | 114 | 980 | 142 | 0.80 | 49 | | |
| X5 | R4 | 671 | 97 | 988 | 143 | 0.68 | 212 | 0.14 | fail |
| TTI | R5 | 734 | 107 | 971 | 141 | 0.76 | 181 | | |
| A4 | R6 | 915 | 133 | 983 | 143 | 0.93 | 19 | 0.56 | fail |
| V5 | R7 | 946 | 137 | 1016 | 148 | 0.93 | 8 | 0.54 | fail |
| N2 | R8 | 311 | 45 | 757 | 110 | 0.41 | | | |
| K | R9 | 951 | 138 | 1065 | 155 | 0.89 | 62 | 0.47 | fail |
| C | R10 | 439 | 64 | 645 | 94 | 0.68 | | | |
| B | R11 | 470 | 68 | 699 | 102 | 0.67 | | | |
| 14 | R12 | 968 | 141 | 1039 | 151 | 0.93 | 45 | 0.39 | pass |

It is reminded that the steel according to the invention has a yield strength of at least 758 MPa (110 ksi).

Preferably, the steel according to the invention has a fracture toughness resistance of at least 68 J at −10° C.

When it comes to corrosion resistance, preferably, the steel according to the invention presents a maximum corrosion rate of 0.13 mm/year. Even more preferably, it passes the SSC test with no crack.

The steel compositions 11 to 15 are according to the invention. These five steels have undergone the preferred process conditions of table 2 to obtain the preferred microstructural features of table 3. As a consequence, the mechanical properties, fracture toughness resistance and corrosion resistance obtained by steels 11 to 15 are in the targeted ranges i.e.: above 758 MPa for the Yield strength and preferably a fracture toughness resistance of at least 68 J at −10° C., a corrosion rate below 0.13 mm/year and a successful SSC test with no crack.

All yield strength values are above 758 MPa (110 ksi) and 13 to 15 even reach more than 862 MPa (125 ksi).

The reference steel R1 is not according to the invention since Cr, Mo, Ni, Cu, V, Co and N contents are out of the ranges of the invention. As a consequence, even though it has undergone preferred production route parameters as detailed in table 2, the yield strength is very low compared to the minimum target of 758 MPa.

The reference steel R2 is not according to the invention since Ni, Cu, Mn, V, Nb, Co and Al contents are out of the ranges of the invention. As a consequence, even though it has undergone preferred production route parameters as detailed in table 2, the retained austenite content is above preferred range of 5-15%. In addition the preferred corrosion resistance response of this material is not satisfying with a corrosion rate of 0.25 mm/year and failed SSC test.

The reference steel R3 is not according to the invention since the Nb content is above the maximum allowed of 0.1%. As a consequence, the fracture toughness response is dramatically impacted with a value at −10° C. of 49 J which is well below preferred value of 68 J minimum. In addition, the microstructural features i.e. the ferrite, retained austenite and martensite contents are out the targeted range.

The reference steel R4 is not according to the invention since the Nb content is below the minimum allowed of 3.2×C where C is in weight %. As a consequence, the C trapping effect is not effective and the minimum yield strength of 758 MPa is not reached.

The reference steel R5 is not according to the invention since Cu and Co contents are out of the ranges of the invention. As a consequence, even though it has undergone preferred production route parameters as detailed in table 2, the ferrite, austenite and martensite contents are outside the preferred ranges. Furthermore, the minimum yield strength of 758 MPa is not reached.

The reference steel R6 is not according to the invention since Ni, Cu, V, Nb, W, Co and Al contents are out of the ranges of the invention. As a consequence, even though it has undergone preferred production route parameters as detailed in table 2, there is no retained austenite in this steel. In addition, intermetallics have been identified while their presence is preferably avoided. Furthermore, the preferred corrosion resistance response of this material is not satisfying with a corrosion rate of 0.56 mm/year and a failed SSC test. Plus, the toughness resistance is well below expectations at 19 J.

The reference steel R7 is not according to the invention since Ni, Cu, Nb, W, Co and Al contents are out of the ranges of the invention. As a consequence, even though it has undergone preferred production route parameters as detailed in table 2, intermetallics have been identified and the corrosion and fracture toughness resistance are not satisfying when compared to preferred targeted behavior. Indeed, the preferred corrosion resistance response of this material is not satisfying with a corrosion rate of 0.54 mm/year and fracture resistance toughness at 8 J.

The reference steel R8 is not according to the invention since Ni, Cu, V, Nb, W and Co contents are out of the ranges of the invention. As a consequence, having undergone preferred production route parameters as detailed in table 2, the microstructure obtained is completely different from the preferred one. The Yield strength obtained is far from the target of 758 MPa.

The reference steel R9 is not according to the invention since Mo, Ni, Cu, Nb and Co contents are out of the ranges of the invention. As a consequence, even though it has undergone preferred production route parameters as detailed in table 2, intermetallics have been identified and the corrosion and fracture toughness resistance are not satisfying when compared to preferred targeted behavior. Indeed, the preferred corrosion resistance response of this material is not satisfying with a corrosion rate of 0.47 mm/year and a failed SSC test. Furthermore, the fracture toughness resistance is equal to 62 J at −10° C., which is below the preferred minimum value of 68 J at −10° C.

The reference steel R10 is not according to the invention since Ni, Cu, V, Nb, and N contents are out of the ranges of the invention. As a consequence, having undergone preferred production route parameters as detailed in table 2, the yield strength reached is well below the target of 758 MPa.

The reference steel R11 is not according to the invention since C, Ni, Mn, W, N and Ti contents are out of the ranges of the invention. Once it has undergone the preferred production route parameters as detailed in table 2, the minimum yield strength of 758 MPa is not reached.

The reference steel R12 is not according to the invention since Ni, Mn, V, Nb and Co contents are out of the ranges of the invention. As a consequence, having undergone preferred production route parameters as detailed in table 2, the microstructure obtained is very different from the preferred one with no retained austenite, an excess of martensite and not enough ferrite. Furthermore, the fracture toughness resistance is as low as 45 J at −10° C., which is below the preferred minimum value of 68 J at −10° C. The corrosion rate is also too high at 0.39 mm/year.

The steel composition claimed by the invention will advantageously be used for the fabrication of seamless tubes for production tubing and production liner, more rarely in the bottom of production casing. Such tubes will preferably be resistant to sulphide stress cracking corrosion and high temperature media.

The invention claimed is:

1. A steel, comprising, in weight %:

$0.005 \leq C < 0.03$;

$14 \leq Cr \leq 17$;

$2.3 \leq Mo \leq 3.5$;

$3.2 \leq Ni \leq 4.5$;

$Si \leq 0.6$;

$0.5 \leq Cu \leq 1.5$;

$0.4 \leq Mn \leq 1.3$;

$0.35 \leq V \leq 0.6$;

$3.2 \times C \leq Nb \leq 0.1$;

$W \leq 1.5$;

$0.5 \leq Co \leq 1.5$;

$0.02 \leq N \leq 0.05$;

$Ti \leq 0.05$;

P≤0.03;
S≤0.005;
Al≤0.05; and
iron,
wherein the steel has a microstructure comprising in area percentage between 30% and 50% of ferrite; and
wherein the steel has a yield strength of at least 758 MPa.

2. The steel according to claim 1, wherein the steel comprises, in weight 15.5≤Cr≤16.5.

3. The steel according to claim 1, wherein the steel comprises, in weight %: 0.8≤Cu≤1.2.

4. The steel according to claim 1, having a microstructure comprising in area percentage between 5% and 15% of austenite.

5. The steel according to claim 1, having a microstructure comprising in area percentage between 35% and 65% of martensite.

6. The steel according to claim 1, having a microstructure with less than 0.5% intermetallics in volume fraction.

7. The steel according to claim 1, having a microstructure with no intermetallics.

8. The steel according to claim 1, having a yield strength of at least 862 MPa (125 ksi).

9. The steel according to claim 1, having a fracture toughness resistance at −10° C. of at least 68 J.

10. A manufacturing method of a steel tube, the method comprising:

hot forming a steel according to claim 1 at a temperature comprised between 1150° C. and 1260° C. by forging, rolling, and extruding to obtain a tube;

heating the tube up to a temperature AT comprised between 920° C. and 1050° C. and maintaining the temperature AT during a time comprised between 5 and 30 minutes followed by cooling to the ambient temperature to obtain a quenched tube; and then heating the quenched tube up to a temperature TT comprised between 500° C. and 700° C. and maintaining the temperature TT during a time Tt comprised between 5 and 60 minutes followed by cooling to ambient temperature to obtain a quenched and tempered tube.

11. The method according to claim 10, wherein at least one cooling to the ambient temperature is done with water.

12. The method according to claim 10, wherein the time Tt is comprised between 10 and 40 min.

* * * * *